US007422183B2

(12) United States Patent
Monteleone et al.

(10) Patent No.: US 7,422,183 B2
(45) Date of Patent: Sep. 9, 2008

(54) PAINT BUCKET LADDER HOOK WITH OPEN GRIP DESIGN HANDLE

(75) Inventors: Vito Monteleone, 2528 Lorenzo, Sterling Heights, MI (US) 48314; Stephen Albert Bardill, Sterling Heights, MI (US)

(73) Assignees: Vito Monteleone, Sterling Heights, MI (US); Stephen A. Bardill, Sterling Heights, MI (US)

( * ) Notice: Subject to any disclaimer, the term of this patent is extended or adjusted under 35 U.S.C. 154(b) by 49 days.

(21) Appl. No.: 11/435,607

(22) Filed: May 17, 2006

(65) Prior Publication Data

US 2007/0272813 A1 Nov. 29, 2007

(51) Int. Cl.
*E06C 7/14* (2006.01)

(52) U.S. Cl. ..... 248/210; 248/303

(58) Field of Classification Search ..... 248/210, 248/211, 113, 303; 211/113, 119; D8/373, D8/367; 182/206; 47/67
See application file for complete search history.

(56) References Cited

U.S. PATENT DOCUMENTS 2,453,189 A * 11/1948 Bogut ..... 248/211
2,519,980 A * 8/1950 Renz ..... 248/211
2,747,825 A * 5/1956 Lachenmayer ..... 348/210
2,855,170 A * 10/1958 Spinello ..... 248/211
4,205,411 A * 6/1980 Cupp et al. ..... 15/257.06
5,062,607 A 11/1991 Kisner
5,276,943 A 1/1994 Ludy
5,402,910 A * 4/1995 Pilney ..... 220/751
393,413 A 4/1998 Brown
5,792,312 A * 8/1998 Dotterman et al. ..... 156/579
5,797,571 A 8/1998 Brophy

* cited by examiner

*Primary Examiner*—Korie H. Chan

(57) ABSTRACT

A ladder hook (122) and a built in handle (126) are embodied together to form a unique paint bucket ladder hook. This present invention has an easy to grip handle for quick maneuverability, for moving a can of paint from rung to rung on an extension ladder. This includes moving the can of paint vertical up or vertical down the ladder rung; or moving the can of paint from left side rail to right side rail of the ladder. The ladder hook can easily be attached to the ladder rung, and at the same time the built in cradle design (128) will hug the sides of the ladder rail. A spring snap hook (138) will secure the can of paint.

1 Claim, 7 Drawing Sheets

PAINT BUCKET LADDER HOOK WITH OPEN GRIP DESIGN HANDLE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to a paint bucket hook for attaching a can of paint securely to an extension ladder.

2. Prior Art

Our invention is for homeowners or professional painters who want to paint the interior or exterior of their building or project. For the longest time there has not been a faster, safer, and easier way to maneuver a paint can from rung to rung on an extension ladder. Our invention solves this problem. Our findings have concluded that the related prior art inventions were much to complicated, and took to much time to maneuver the paint can from rung to rung on an extension ladder. This lagging time factor makes their invention unsafe for the painter who may be at high elevation on the extension ladder. Furthermore these other similar inventions are cumbersome. Prior art displayed various types of paint bucket hooks and holders for attaching or mounting a paint can to a ladder. Unfortunately, these designs did not have an easy to grip built in handle to improve better agility to the gripping action of the paint bucket ladder hook. Furthermore, some of the other similar inventions were not designed for left and right-handed painters; they were made for right-handed painters only. Various paint bucket hooks and holders for attaching a can of paint to a ladder do exist.

U.S. Pat. No. 5,062,607 to Kisner (1991) discloses a paint can holder for detachably mounting a receptacle such as a paint can to a ladder. However, this invention does not have the easy to grip built in handle for quick and agile maneuverability. Furthermore, this will cause the painter to have difficulty moving the paint can from rung to rung on an extension ladder. This defect will slow down the painter's production.

U.S. Pat. No. 5,276,943 to Ludy (1994) a handle for a paint can suspends the can securely from a ladder rung in a stationary mode. Unfortunately, this invention does not have the easy to grip built in handle, for fast and easy paint can movement from rung to rung on an extension ladder. This problem will hinder the painter's performance and efficiency by its stationary design.

U.S. Pat. No. 393,413 to Brown (1998) an ornamental design paint bucket hook for a ladder does not have the easy to grip built in design handle for faster, safer, and easier maneuverability. Therefore, getting the paint can from rung to rung on an extension ladder will be slow and difficult for most painters. Some painters may need to use two hands to disengage the hook from the rung of the ladder, which will create a dangerous situation; there by meaning the painter will not be holding onto the ladder at all for an undetermined amount of time.

U.S. Pat. No. 5,797,571 to Brophy (1998) has a combined ladder hook and bracket assembly for holding a can of paint to a ladder. Unfortunately, this invention is made for right-handed painters only. You will see that in this inventor's drawing a right side rung mounting system consisting of a closed loop eyelet and swivel hook built into the adjustable arm for right hand painting. Furthermore, you will notice the open loop on the left side of the arm. This open loop is simply a stop, to prevent the arm from sliding out of the brackets. I would like to add, there is not a built in easy to grip handle; to move the paint can from rung to rung on the ladder. Moreover, without the easy to grip handle on this design the invention will be slow while trying to move the paint can from rung to rung on the ladder. Furthermore, this lagging time makes this invention unsafe because the painter may be very high up on the ladder.

3. Objects and Advantages

Several objects and advantages of the present invention are:

(a) To provide a paint bucket ladder hook with an open grip design handle.
(b) To provide a paint bucket hook for a ladder, for right and left-handed painters.
(c) To provide a faster way for the painter to move the paint can from rung to rung on an extension ladder, as a single unit while the paint can is securely attached to the ladder hook. This includes moving the paint can vertical up and vertical down the rung of the extension ladder.
(d) To provide a safer and easier way for the painter to maneuver the paint can from horizontal left on the rung of the extension ladder, to horizontal right on the rung of the extension ladder.
(e) To provide an easy to grip handle so the painter can move the paint can from rung to rung on an extension ladder using only one hand.
(f) To provide a built in cradle design to hug the front ladder rails left or right side for greater stability.
(g) To provide a strong, secure hook and handle.
(h) To provide a simple lightweight design for greater maneuverability.
(i) To provide convenient paint can access so the painter can improve production.

Further objects and advantages of the invention will become apparent from a consideration of the drawings and ensuing description.

SUMMARY

In accordance with the present invention the primary object is to provide painters a fast and safe way to move the paint can from rung to rung on an extension ladder. This task can be accomplished by using our paint bucket ladder hook with open grip design handle. The painter simply attaches the paint bucket to the bottom of the spring snap hook then grips the handle and attaches the paint can securely to the rung of the ladder, through means of the top hook.

DRAWINGS—FIGURES

Figure 1:
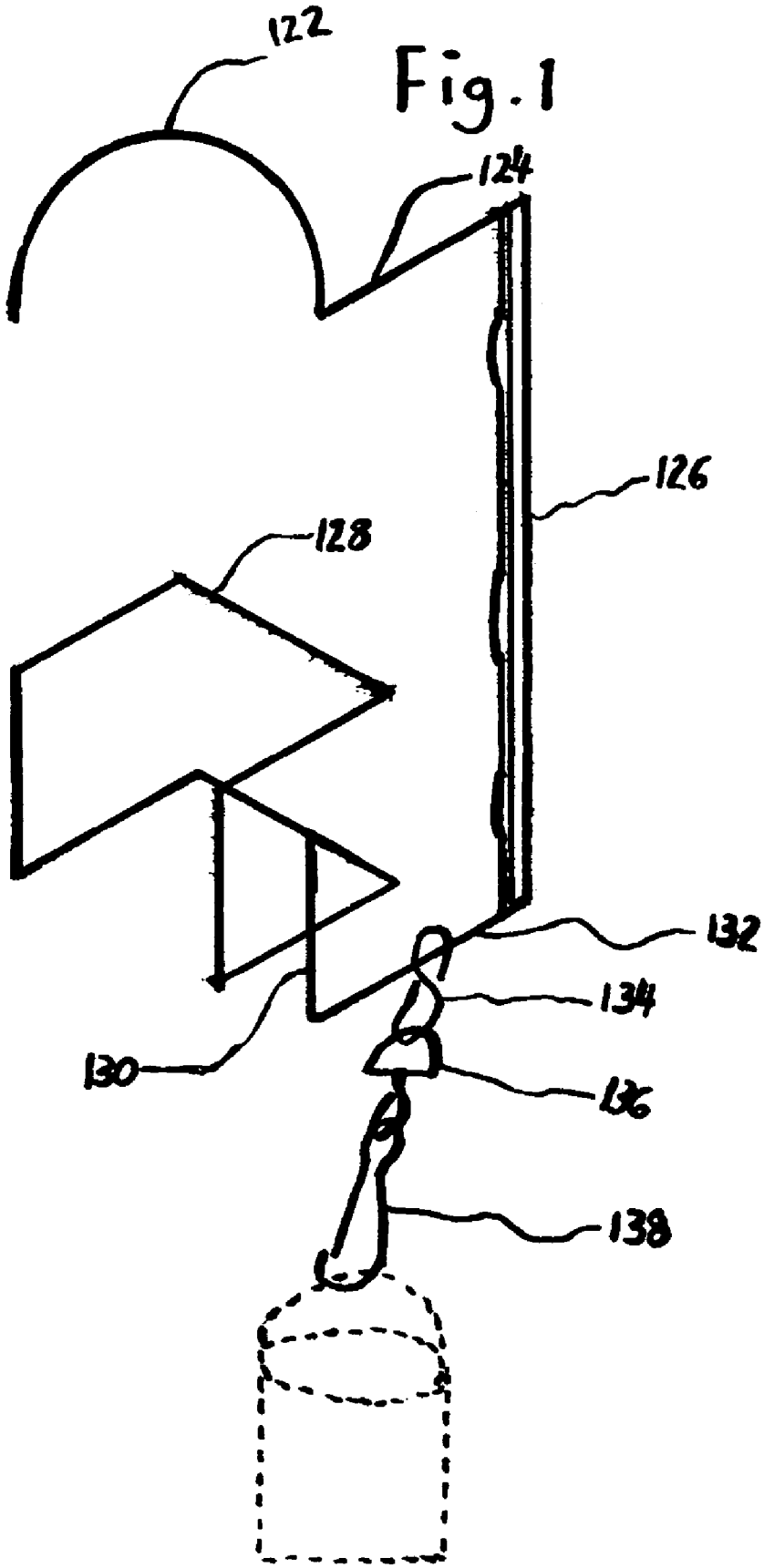
FIG. 1 is an isometric view of the paint bucket ladder hook with open grip design handle.
Figure 2:
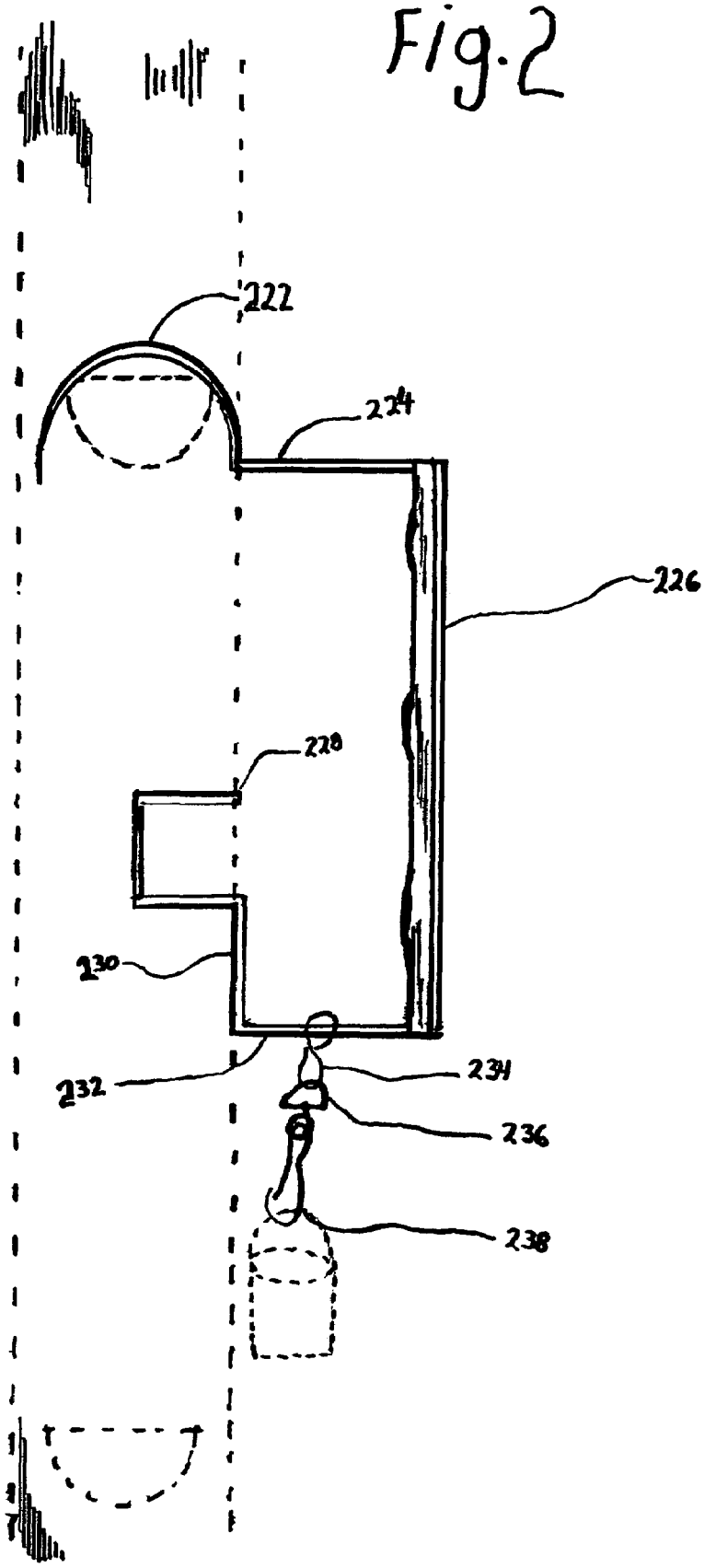
FIG. 2 is a left side view of the paint bucket ladder hook securely attached to an extension ladder rung and rail, with the paint can secure to the spring snap hook.
Figure 3:
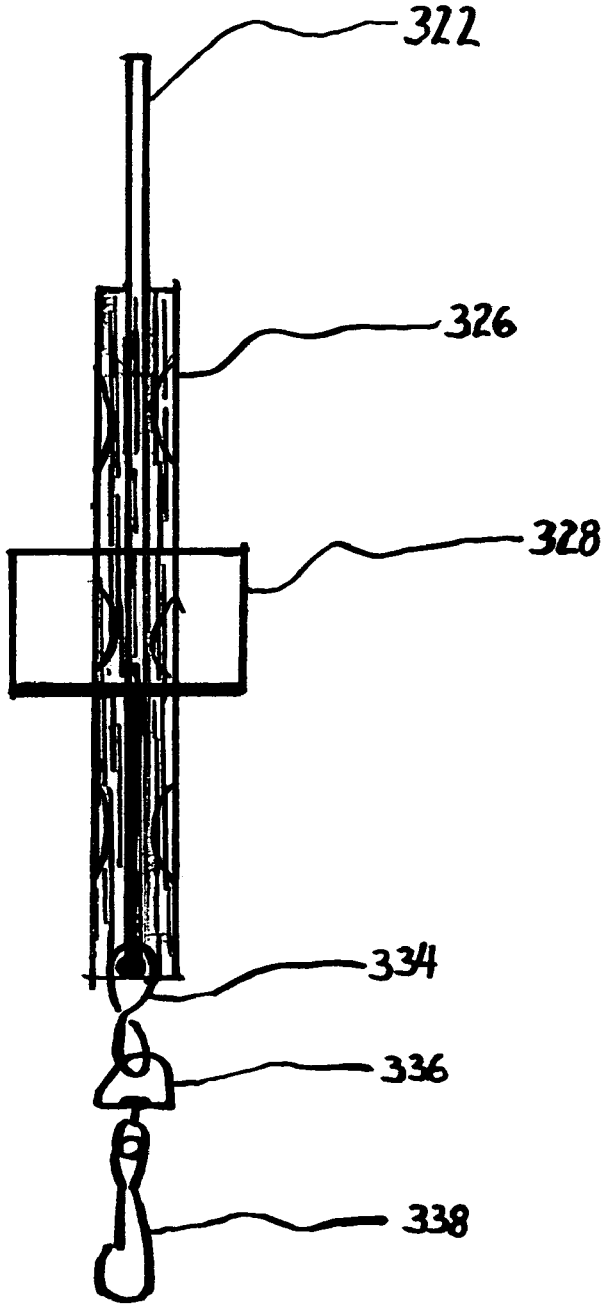
Figure 4B:
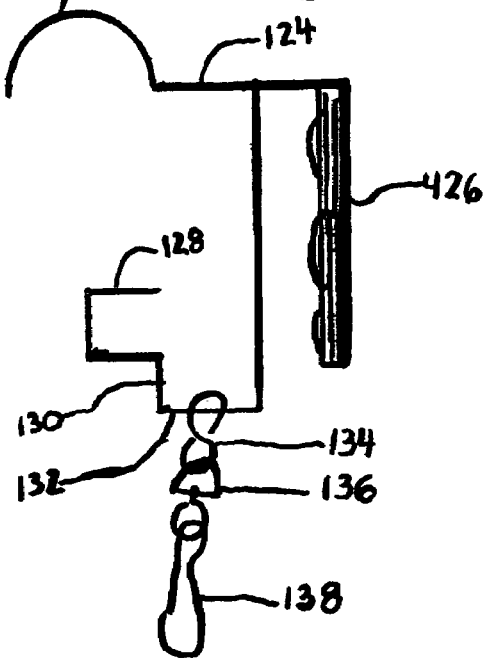

FIG. 3 is a front view of the paint bucket ladder hook with open grip design handle. The broken line showing the paint bucket in FIG. 1 and FIG. 4I are for illustrative purposes only and forms no part of the claimed design. Moreover, the broken line in FIG. 2 showing the side of the extension ladder rail and rung are for illustrative purposes only.

DRAWINGS—REFERENCE NUMERALS

122, 222 and 322 rounded extension ladder rung hook
422 square extension ladder rung hook
124 and 224 upper horizontal frame
126, 226 and 326 open grip handle
426 alternative handles
128, 228 and 328 ladder rail cradle
130 and 230 lower vertical frame
132 and 232 lower horizontal frame
134, 234 and 334 S-hook
136, 236 and 336 swivel
138, 238 and 338 spring snap hook
438 one piece lower hook

DETAILED DESCRIPTION—PREFERRED EMBODIMENT

Referring to the drawings and especially FIG. 1, a paint bucket extension ladder hook with open grip design handle; for moving the paint can quickly from rung to rung on an extension ladder. Constructed in accordance with the invention a strong metal is formed in the shape of a hook with a built in handle. FIG. 1 shown has a rounded extension ladder rung hook 122 connected to the upper horizontal frame 124. Upper horizontal frame 124 also connects to the upper end of the open grip handle 126. Open grip handle 126 then connects to the lower horizontal frame 132. Lower horizontal frame 132 connects to lower vertical frame 130. Lower vertical frame 130 then connects to ladder rail cradle 128. S-hook 134 is connected to lower horizontal frame 132. Swivel 136 is connected to S-hook 134. Spring snap hook 138 is connected to swivel 136. As shown in FIG. 1 the drawing with broken lines is a depiction of the paint can securely attached to the spring snap hook 138.

Operation—Preferred Embodiment

FIGS. 1, 2 and 3 will illustrate the intended use and operation of the paint bucket ladder hook with handle. FIG. 1 illustrates the rounded extension ladder rung hook 122. This hook is designed to hang easily and securely to a rung of an extension ladder. Upper horizontal frame 124 and lower horizontal frame 132 are both connected to the open grip handle 126, this design gives the painter an easy to grip fast action handle; for maneuvering the paint can easily from rung to rung on an extension ladder. Lower horizontal frame 132 connects to lower vertical frame 130 there by creating a base for ladder rail cradle 128 to mount onto. This cradle design will hug either side of the extension ladder rail, creating a secure mount every time for the user. The painter can attach a full can of paint to the spring snap hook 138. This will create a one-piece unit for the painter. The painter can now move the paint can fast and efficiently from rung to rung on an extension ladder in a safe and secure manner.

FIG. 2 illustrates a side view of the rounded extension ladder rung hook 222. Open grip handle 226 connects to upper horizontal frame 224 and lower horizontal frame 232. S-hook 234 is connected to lower horizontal frame 232. Swivel 236 is connected to S-hook 234. Spring snap hook 238 is connected to swivel 236. A full can of paint will be securely attached to the spring snap hook 238 through the paint can wire handle. Ladder rail cradle 228 will hug either side of the extension ladder rail; creating a secure mount for the user. FIG. 2 shows broken lines replicating an extension ladder, with the paint hook securely attached onto. FIG. 2 also shows the paint can securely attached to the spring snap hook 238. Therefore, giving the painter's a single unit to move quickly and efficiently from rung to rung on an extension ladder.

FIG. 1 illustrates the cradle 128 can be mounted to either a left or right side rail on an extension ladder. Therefore, this invention is ideal for left or right-handed painters.

FIG. 2 shows a side view of the paint bucket ladder hook with open grip design handle. The combination of rounded extension ladder rung hook 222 and ladder rail cradle 228 creates a solid mount every time for the user. Open grip handle 226 is designed for hand held gripping; for left or right-handed painters enabling workers to move the paint can fast and efficiently from rung to rung on an extension ladder. FIG. 3 illustrates the front view.

Description—Alternative Embodiment

There are various alternative embodiments and configurations for the present invention. These alternative embodiments are listed as FIG. 4A through FIG. 4J.

Figure 4A:
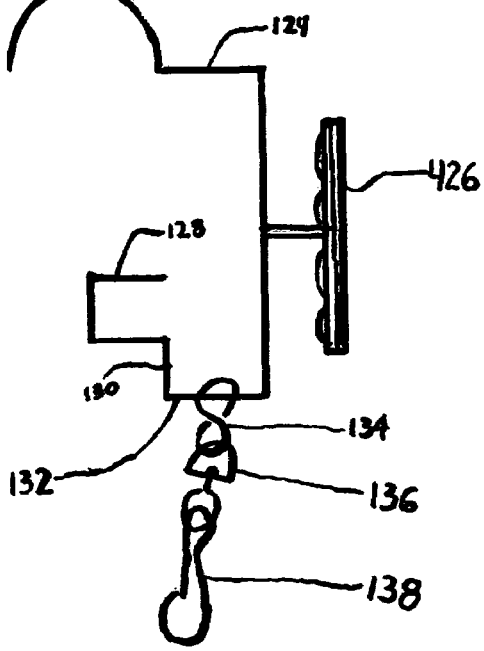

FIG. 4A is a design of a T-shaped handle.

FIG. 4B shows a top mounted open grip handle.

Figure 4C:
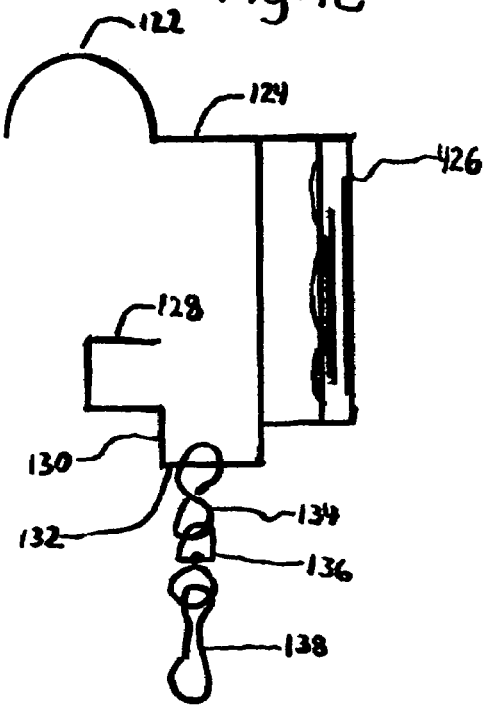

FIG. 4C illustrates a top mounted closed grip handle.

Figure 4D:
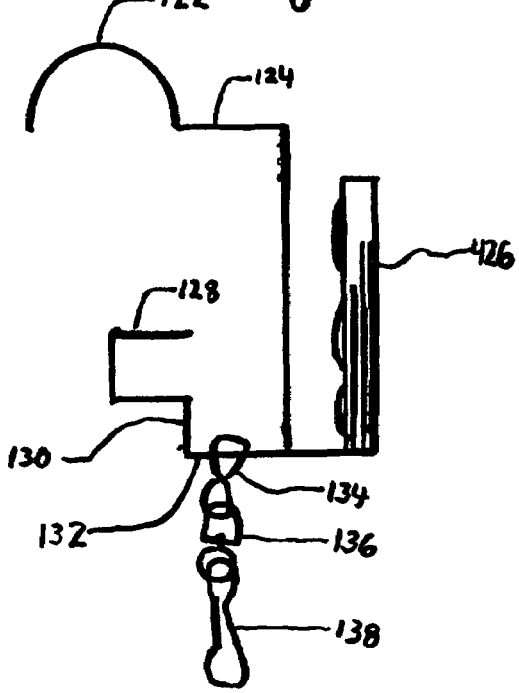

FIG. 4D shows a bottom mounted open grip handle.

Figure 4E:
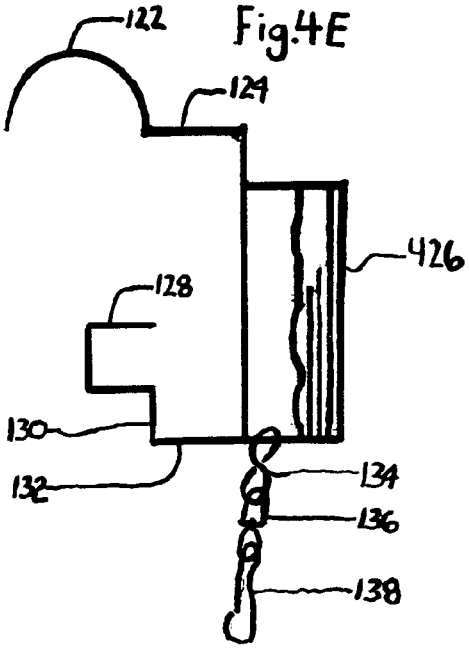

FIG. 4E displays a bottom mounted closed grip handle.

Figure 4F:
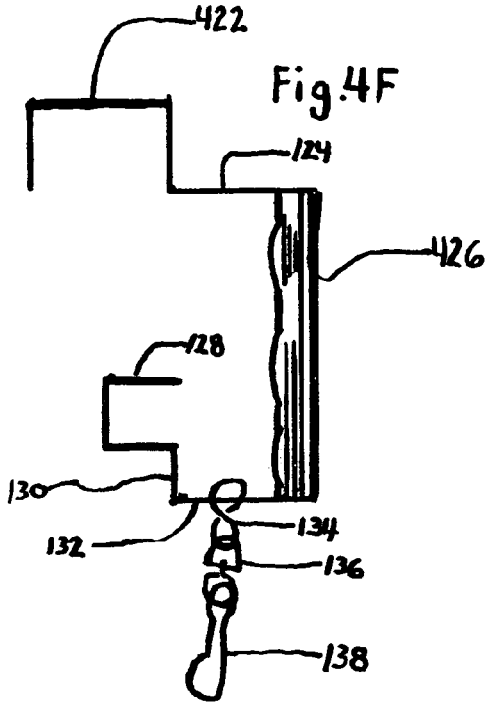

FIG. 4F illustrates a square design extension ladder rung hook.

Figure 4G:
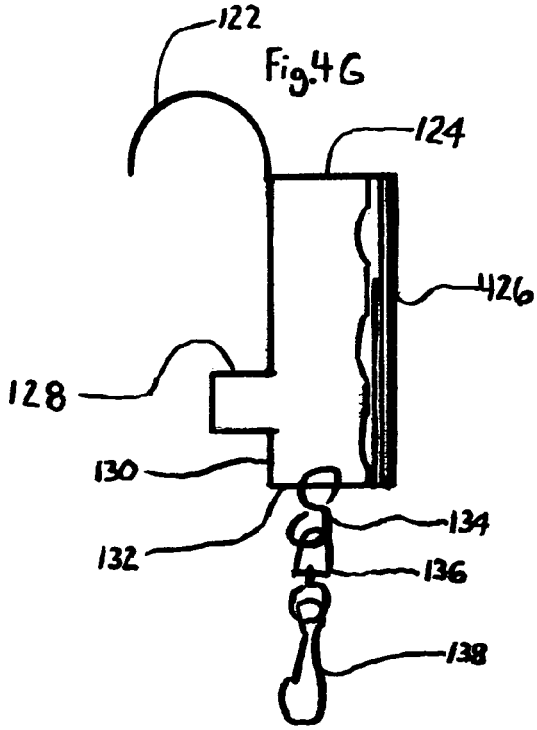

FIG. 4G shows a complete rectangle type style handle.

Figure 4H:
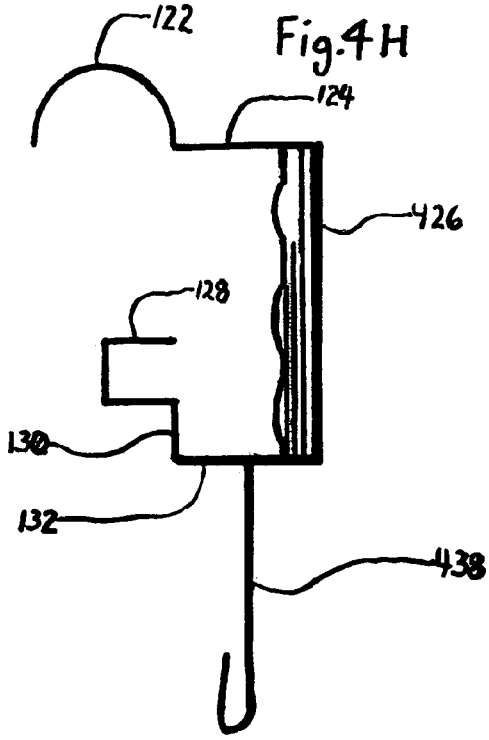
Figure 4I:
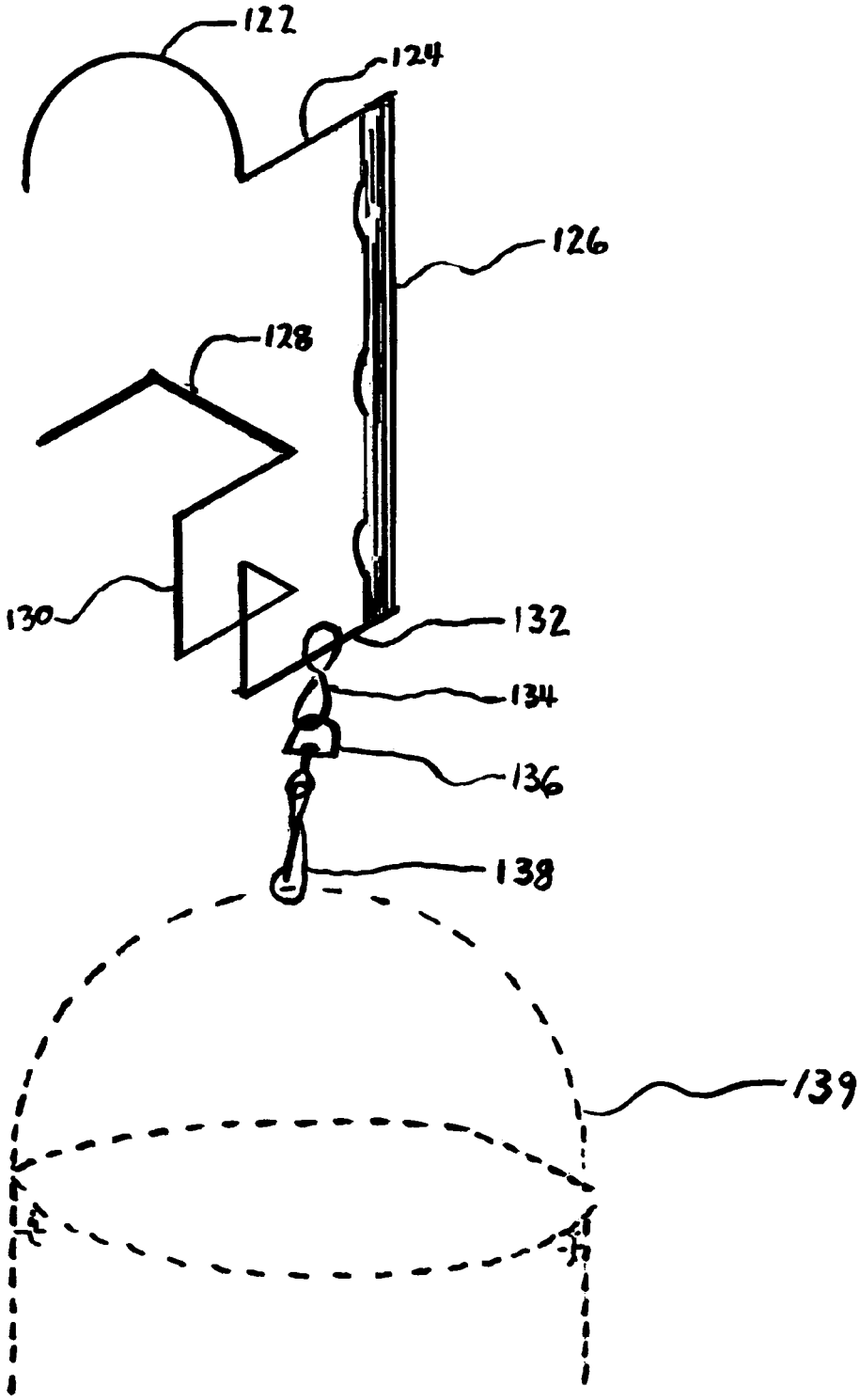

FIG. 4H illustrates a solid lower hook as part of the embodiment for attaching a paint can.

Figure 4J:
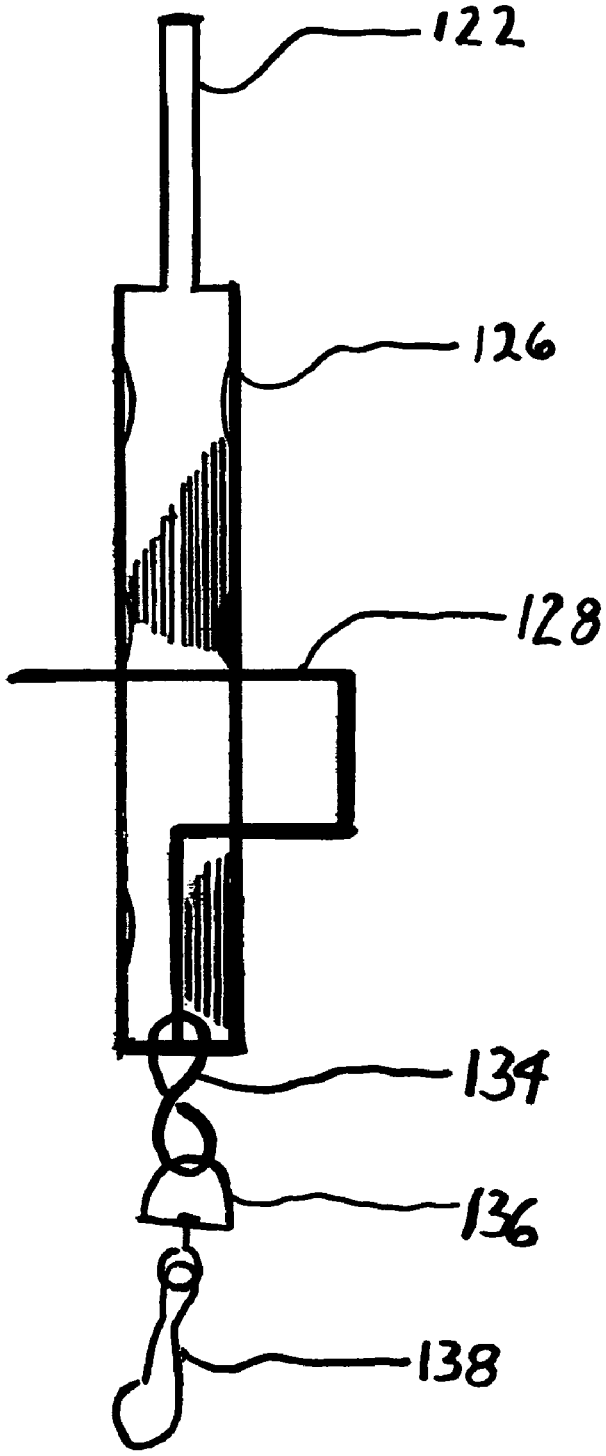

FIG. 4I and FIG. 4J displays a partial cradle design extension ladder rung hook.

FIG. 4A is a side view of the paint bucket ladder hook with an alternative T-shaped handle. This T-shaped handle is easy to grasp for left or right-handed people. This design will make it easy for the painter to move the paint bucket from rung to rung on an extension ladder.

FIG. 4B is a side view of the paint bucket ladder hook with an alternative top mounted open grip handle. This top mounted handle is simple to grasp for right or left-handed painters. Note: open grip meaning a handle without a complete encirclement. This design has great maneuverability from rung to rung on an extension ladder.

FIG. 4C is a side view of the paint bucket ladder hook with an alternative top mounted closed grip handle, meaning a handle with a complete encirclement. This design gives the Painter a simple to grip handle for better productivity moving a can of paint from rung to rung on an extension ladder.

FIG. 4D is a side view of the paint bucket ladder hook with an alternative bottom mounted open grip handle. This design makes it faster for the homeowner to move the paint can from rung to rung and left or right side rail on an extension ladder.

FIG. 4E is a side view of the paint bucket ladder hook with an alternative bottom mounted closed grip handle. This design has a quick gripping action for easy maneuverability for the user. This design is made for moving the paint can from rung to rung on an extension ladder.

FIG. 4F is a side view of the paint bucket ladder hook with an alternative square type ladder rung hook. This design is for moving the paint can from rung to rung on an extension ladder, either left or right side of the ladder rail. Left or right-handed people can easily grasp the open grip handle.

FIG. 4G is a side view of the paint bucket ladder hook with an alternative complete rectangle type style handle. This design is for safer and quicker mobility, for the user to grip and move the paint can from rung to rung, up or down on an extension ladder.

FIG. 4H is a side view of the paint bucket ladder hook with an alternative one piece solid lower hook as part of the frame to attach a can of paint. This design does not have the S-hook, swivel, and spring snap hook as in the other designs. This design is also for left or right-handed painters.

FIG. 4I is an isometric view of the paint bucket ladder hook with an alternative partial cradle design.

FIG. 4J is a front view of the paint bucket ladder hook with an alternative partial cradle design.

Advantages

From the description above, a number of advantages of our present invention are evident:

(a) The painter can very quickly move the paint bucket ladder hook with the can of paint attached to it as a single unit.
(b) The user can safely transport the paint bucket ladder hook as a single unit to the desired position on an extension ladder with one hand.
(c) As the work progresses the user can very easily and quickly reposition the paint can on either side of an extension ladder; left or right side rail.
(d) As the painting progresses, the painter can move the can paint can up or down the rung of the extension ladder in a fast and safe manner.
(e) The user can be a right or left-handed person.
(f) The paint bucket ladder hook is simple and lightweight for ease of use.
(g) The paint bucket ladder hook can be economically manufactured in quantities.
(h) The paint bucket ladder hook makes a workers job faster, safer, easier, and increases their paint production by saving time, through its quick grip handle.

CONCLUSION, RAMIFICATIONS, AND SCOPE

The present invention is an innovative simple design solution, for attaching a can of paint to an extension ladder. The emphasis of the invention is primarily directed toward addressing the key issues of the painter's productivity, ease of use and safety while painting high up on an extension ladder. The easy to grip handle on our paint bucket ladder hook makes this hook simple and unique. Furthermore, the painter can hold onto the ladder safely with one hand, and move the paint can with the other hand in a quick and safe manner.

Although the description of the present invention contains specifics of the preferred embodiment, these should not be construed as limiting the scope of the invention. The Embodiment described herein is subject to variation in structure, design, and manufacturing methodology. For example, practical variable alternatives are presented herein for a handle grip.

Accordingly, the scope of the invention should be determined by the appended claims and their legal equivalents, and not be limited to the details disclosed herein.

We claim:

1. A paint bucket ladder hook assembly for suspending a paint bucket to a ladder rung comprising an upper hook for suspending from the ladder rung, an open grip handle for moving the hook assembly, a ladder rail cradle for connection to a ladder rail, and a lower hook for supporting a paint bucket;

wherein the open grip handle includes an upper horizontal frame having a first end and a second end, a vertical handle frame having an upper end and a lower end, a lower horizontal frame having a first end and a second end, the first end of the upper horizontal frame is connected to the upper end of the vertical handle frame and the first end of the lower horizontal frame is connected to the lower end of the vertical handle frame;

the upper hook having an end connected to the second end of the upper horizontal frame, the upper hook disposed above the upper horizontal frame, a lower vertical frame having a lower end connected to and extending upwardly from the second end of the lower horizontal frame, the lower vertical frame having an upper end;

the ladder rail cradle located above the lower horizontal frame wherein the ladder rail cradle having a U-shaped configuration attached to the upper end of the lower vertical frame;

the lower hook includes a metal link suspended from and movable along the lower horizontal frame and a swivel attached below the metal link and a spring snap hook attached below the swivel for suspending a paint bucket.

* * * * *